United States Patent [19]

Roth

[11] Patent Number: 4,693,391

[45] Date of Patent: Sep. 15, 1987

[54] CLOSURE HAVING A PULL TAB AND A CONTROLLED SEAL WIDTH AT THE PULL TAB

[75] Inventor: Donald J. Roth, Westport, Conn.

[73] Assignee: Continental Can Company, Inc., Norwalk, Conn.

[21] Appl. No.: 922,340

[22] Filed: Oct. 23, 1986

[51] Int. Cl.[4] ..... B65D 41/00

[52] U.S. Cl. ..... 220/359; 220/260

[58] Field of Search ..... 220/260, 359; 229/43; 206/631, 632

[56] References Cited

U.S. PATENT DOCUMENTS 4,044,941 8/1977 Knudsen ..... 220/359
4,207,989 6/1980 Ingemann ..... 229/43
4,215,797 8/1980 Chen ..... 229/43
4,605,142 8/1986 Itoh et al. ..... 220/359

*Primary Examiner*—George T. Hall
*Attorney, Agent, or Firm*—Charles E. Brown

[57] ABSTRACT

This disclosure relates to a closure having a plastic layer which is to be heat bonded to a plastic outer layer of a container. The closure is provided with a pull tab to facilitate the removal thereof from the container. Heat bonding of the closure to the container is effected by induction heating utilizing a metal foil barrier layer within the closure. By offsetting a portion of the closure in alignment with the pull tab, the bond between the closure and the container may be configurated so as to facilitate the initial peeling of the closure from the container when the pull tab is lifted.

7 Claims, 7 Drawing Figures

CLOSURE HAVING A PULL TAB AND A CONTROLLED SEAL WIDTH AT THE PULL TAB

This invention relates in general to new and useful improvements in closures and more particularly to a closure for a bowl or box type container wherein the closure is sealed to the container by way of a heat bond between opposing plastic surfaces. More particularly, this invention relates to improvements in a closure having a pull tab for effecting the removal thereof and wherein the seal or bond configuration between the closure and the container in alignment with the pull tab is generally circular and thus has an undesirably wide seal surface transversely of the axis of the pull tab.

In accordance with this invention, the closure is embossed so as to be upwardly offset generally in radial alignment with the pull tab so as to restrict the surface of the closure which is presentable for bonding to a container and thereby reducing the width of the seal or bond in alignment with the pull tab.

Most particularly, the configuration of the upward offsetting of the closure in alignment with the pull tab is pointed in a radially outwardly directed direction and generally centered on the pull tab radial axis.

With the above and other objects in view that will hereinafter appear, the nature of the invention will be more clearly understood by reference to the following detailed description, the appended claims, and the several views illustrated in the accompanying drawing.

Figure 1:
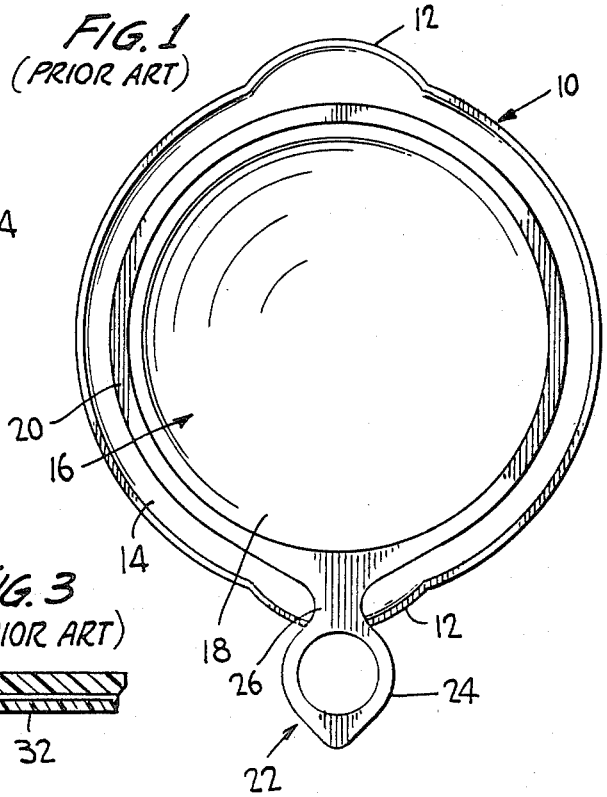
FIG. 1 (PRIOR ART)
FIG. 1 is a prior art showing in the form of a circular bowl-like container closed by a closure having a pull tab for effecting the peeling of the bond between the closure and the container.

Referring now to the drawings in detail, it will be seen there there is illustrated in FIG. 1 a prior art showing which includes a container 10 in the form of a bowl which is circular in outline except for two diammetrically opposite handles 12. The bowl 10 is configurated to be symmetrical about a diagonal line extending through the centers of the handle 12.

In order to facilitate the closing of the bowl or container 10, there is a flat upper annular sealing surface 14. To this sealing surface 14 there is bonded a closure 16 which includes a downwardly recessed central portion 18 and an annular sealing rim 20. The closure 16 is also provided with a pull tab 22 which extends radially outwardly therefrom. The pull tab 22 includes an apertured finger gripping portion 24 connected to the remainder of the closure by a nose portion 26.

Figure 3:
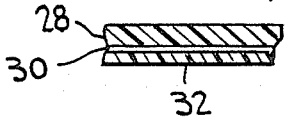
FIG. 3 (PRIOR ART)
FIG. 3 is an enlarged fragmentary sectional view taken through the closure showing the general cross section thereof.
Figure 4:
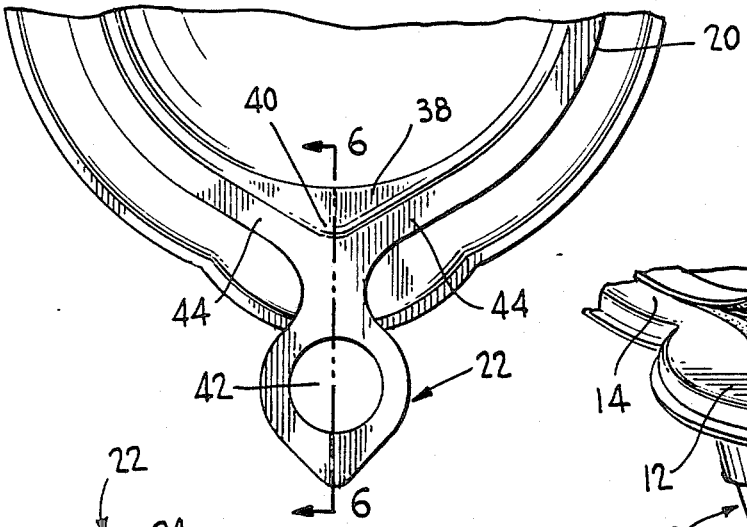
FIG. 4 is an enlarged fragmentary plan view of the container of FIG. 1 having applied thereto an improved closure in accordance with this invention.

At this time it is pointed out that both the prior art bowl or container 10 and the prior art closure 16 are of a laminated construction. Further, the prior art bowl will have an outermost layer which is internally rupturable to permit the removal of the closure 16. On the other hand, the closure 16, as is best shown in FIG. 3, includes an outermost structural layer 28, an inner barrier layer 30 and an innermost bonding layer 32. The layer 32 will heat bond to the outermost layer of the laminate from which the container 10 is formed.

Further, the barrier layer 30 is in the form of a metal foil, preferably aluminum foil and the heat bonding of the closure 16 to the container 10 is effected by induction heating of the opposed plastic layers through electrical energy being inducted into the metal foil layer 30.

The closure 16 is removed from the container 10 by grasping the pull tab 22 and pulling upwardly and towards the center of the closure 16 to effect a peeling rupturing of the outermost layer of the container 10. The ruptured surface portion of the outermost layer 10 remains on the undersurface of the closure 16 and is identified by the numeral 34 in FIG. 2. It will be seen from the ruptured bond pattern that while only a limited seal width must be initially peeled as at 36, as the peeling continues, the seal width extending normal to the radial axis of the pull tab 22 gradually increases and becomes quite wide. As a result, the tension which must be applied to the pull tab 22 is very high and it is very difficult to remove the closure 16 from the container 10.

This invention relates to a modification of the closure 16 to include an upwardly offset embossed portion 38. This embossed portion 38 is generally triangular in plan and has a pointed part 40 which is radially outermost and which is in alignment with a radial axis 42 of the pull tab 22.

Most particularly, it will be seen that the embossed portion 38 interrupts the circular configuration of the annular sealing rim 20 so that in the vicinity of the pull tab 22, the sealing rim has two straight line portions 44 which converge towards the axis 42 of the pull tab 22.

At this time it is pointed out that the bond between the closure 16 and the container 10 is normally effected by means of a high frequency induction coil (not shown) having an effective shape corresponding to the outline of the sealing rim 20. This coil is normally circular in outline, but is particularly configurated to have a pointed nose portion in alignment with the pull tab 22. Thus the heating of the metal foil layer 30 is primarily in alignment with the induction coil which, in turn, is primarily in alignment with the sealing rim 20.

Figure 2:
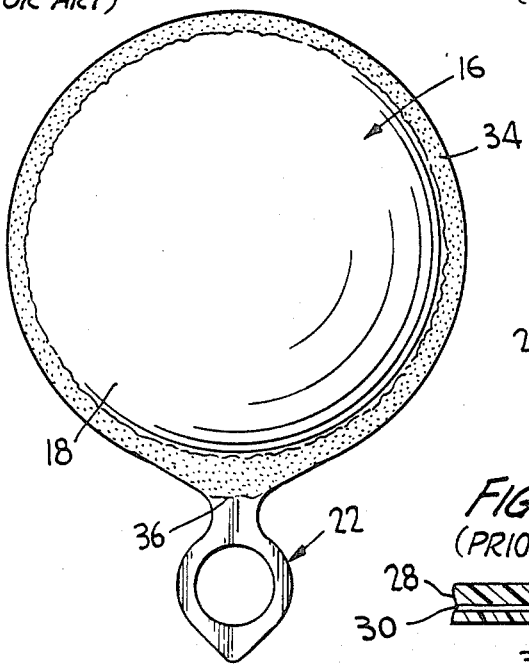
FIG. 2 (PRIOR ART)
FIG. 2 is a bottom plan view of the pull tab of FIG. 1 removed from the container and showing the pattern of the seal or bond between the closure and the container.
Figure 5:
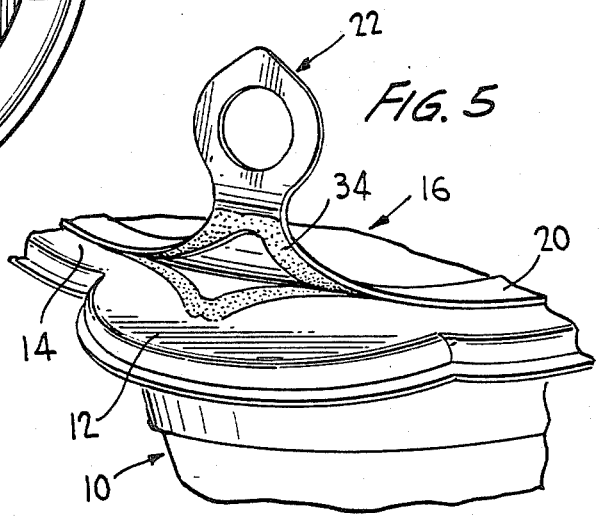
FIG. 5 is a fragmentary top perspective view showing the container of FIG. 4 partially open.
Figure 6:
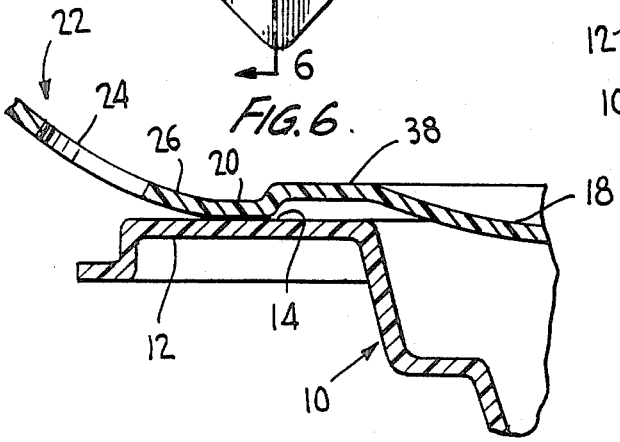
FIG. 6 is an enlarged fragmentary vertical sectional view taken generally along the line 6—6 of FIG. 4 and shows the general cross section of the container and the closure along the axis of the pull tab.
Figure 7:
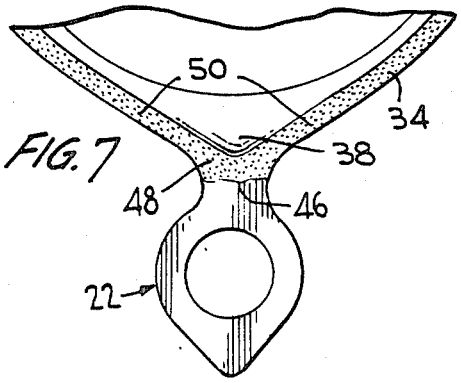
FIG. 7 is an enlarged fragmentary bottom plan view of the closure after it has been removed from the container and shows the configuration of the seal or bond between the closure and the container in the vicinity of the pull tab.

Referring now to FIG. 5, it will be seen that when the pull tab 22 of the modified cover is grasped and pulled back upon itself, and rupture occurs in the bond between the cover 16 and the container 10, the outline of the ruptured material 34 defining the configuration of the bond is materially changed from the circular configuration of FIG. 2 to a generally pointed configuration. As is best shown in FIG. 7, the bond as at 46, which is the starting point of the seal separation is of the same width as at 36 in FIG. 2. However, while there is a slight increase in the width of the bond due to a slight divergence of the nose 26 of the pull tab as at 48, the increase in the width of the bond is relatively small and after a very limited peeling action, the bond separates into two independent legs 50 as provided for by the upwardly offset embossed portion 38.

Thus while the tension on the pull tab 22 required to effect rupture of the bond between the closure 16 and the container 10 is sufficiently high to prevent accidental opening of the container, the controlled seal width prevents the tension from becoming too high which would make it difficult for some people to open the container. Once peeling of the bond is initiated, it rapidly divides into two separate peeling actions along the legs 50 so that complete removal of the closure 16 may be effected without any undue hindrance.

By controlling the seal width through the modification of the closure 16, it will be seen that the pull tab 22 may be aligned with either of the two handles 12 of the container and no orientation problem is presented.

Although only a preferred embodiment of the closure configuration has been specifically illustrated and described herein, it is to be understood that minor variations may be made in the closure configuration without departing from the spirit and scope and of the invention.

We claim:

1. A closure, said closure being of the type constructed to have a rupturable bonded seal with a container and including a projecting pull tab for effecting removal of said closure, said pull tab having a radial axis, said closure being circular in outline at least at said pull tab, and said closure in alignment with said pull tab and radially inwardly of said pull tab being upwardly offset to change a configuration of a bonding surface of said closure from circular to angular to reduce an effective width of said bonding surface transversely of said pull tab axis and thus a peeling force required to remove said closure.

2. A closure according to claim 1 wherein said upwardly offset portion is of a configuration which is pointed in a radially outwardly directed direction.

3. A closure according to claim 1 wherein said upwardly offset portion is of a configuration which is pointed in a radially outwardly directed direction, and generally centered on said pull tab radial axis.

4. A closure according to claim 1 wherein said closure includes a metal foil barrier layer, and said metal foil barrier layer forming means for effecting induction heating of said cover to effect heat bonding of said cover to a container.

5. A closure according to claim 1 wherein with the exception of said pull tab, said closure is circular in outline.

6. A closure in accordance with claim 1 together with a container of a circular outline and having two handles, and said closure being heat bonded to said container with said pull tab being selectively aligned with one of said handles.

7. A combination according to claim 6 wherein said container is symmetrical about an axis passing through centers of said handles, and the configuration of said closure permits said selective alignment of said pull tab with either of said handles.

* * * * *